United States Patent [19]

Murakami et al.

[11] Patent Number: 4,932,901

[45] Date of Patent: Jun. 12, 1990

[54] WEDGE-BASE LAMP AND SOCKET ASSEMBLY

[75] Inventors: Yukio Murakami, Kasukabe; Akira Toyoshima, both of Shiki, Japan

[73] Assignee: Tokyo Electric Co., Ltd., Tokyo, Japan

[21] Appl. No.: 237,910

[22] Filed: Aug. 29, 1988

[30] Foreign Application Priority Data

Sep. 2, 1987 [JP] Japan ..... 62-219788

[51] Int. Cl.[5] ..... H01R 17/00

[52] U.S. Cl. ..... 439/619; 439/699

[58] Field of Search ..... 439/611, 617, 619, 918, 439/677, 680, 168, 220, 356, 375, 699; 313/313, 315, 318

[56] References Cited

U.S. PATENT DOCUMENTS

| | | | |
|---|---|---|---|
| 3,048,642 | 8/1962 | Parker, Jr. | 439/677 |
| 3,233,207 | 2/1966 | Ahroni et al. | 439/611 |
| 3,399,374 | 8/1968 | Pauza et al. | 439/680 |
| 4,152,622 | 5/1979 | Fitzgerald | 313/318 |
| 4,171,497 | 10/1979 | Shinoda | 439/619 |
| 4,759,730 | 7/1988 | Sappington et al. | 439/680 |

FOREIGN PATENT DOCUMENTS

| | | | |
|---|---|---|---|
| 2585891 | 2/1987 | France | 439/680 |
| 60-10436 | 3/1985 | Japan . | |
| 0044939 | 3/1985 | Japan | 313/318 |
| 60-136079 | 9/1985 | Japan . | |
| 61-193386 | 8/1986 | Japan . | |

*Primary Examiner*—David Pirlot

*Attorney, Agent, or Firm*—Frishauf, Holtz, Goodman & Woodward

[57] ABSTRACT

A single filament type wedge-base lamp has projections on opposite sides at opposite end portions of a flat base of the lamp, and the corresponding socket has a recess with clearance grooves corresponding in position to the projections. The socket for a double filament type wedge-base lamp has a recess without clearance grooves so that the single filament type wedge-base lamp, which has the projections thereon, is prevented from erroneously being inserted into the double-filament type lamp socket since the projections will interfere with the recess walls of the double-filament type lamp socket. If a double filament type lamp is inserted into the socket for a single filament type lamp, either one of the two filaments thereof will operate without posing a problem.

5 Claims, 1 Drawing Sheet

WEDGE-BASE LAMP AND SOCKET ASSEMBLY

BACKGROUND OF THE INVENTION

1. Field of the Invention

The present invention relates to a wedge-base lamp and socket assembly for use as lightning devices for vehicles and more particularly, to an assembly of a wedge-base lamp (without its plug) and a socket, which assembly ensures fool-proof coupling between different types of wedge-base lamps and sockets.

2. Description of the Related Art

Conventionally, double filament lamps such as vehicle stop-tail lamps have not been used in the form of a wedge-base type lamp. The reason for this is that means for preventing erroneous coupling between different types of wedge-base lamps and sockets have not been provided heretofore, contrary to the coupling between lamps with their specific plugs and corresponding sockets.

Since plugs are not necessary for wedge-base lamps, the number of manufacturing steps thereof is reduced and the material for plugs are dispensed with, thus resulting in cost effectiveness. Double filament type wedge-base lamps have long been desired in consideration of the above advantageous effects. Although single filament type wedge-base lamps are prevailing in the art, double filament type wedge-base lamps are not available in the market because of the lack of proper means for preventing erroneous coupling.

SUMMARY OF THE INVENTION

It is heretofore an object of the present invention to provide a wedge-base lamp and socket assembly which can prevent erroneous coupling between different types of lamps and sockets.

The above objects are achieved by the assembly of a lamp and a socket of this invention.

According to one aspect of the present invention, an assembly of a wedge-base lamp and a socket comprises a wedge-base lamp having a pair of wire leads for a filament, said wire leads being folded back on opposite sides at opposite end portions of a flat base of the lamp, and projections at end portions opposite to said first-mentioned opposite end portions. The socket has a recess providing electrical contacts for contacting with said pair of wire leads and is provided with clearance grooves in a wall of said recess corresponding in position to said projections for introducing said flat base with the projections into said socket to couple said lamp and socket together.

According to another aspect of the present invention, an assembly of a wedge-base lamp and a socket comprises a wedge-base lamp having two pairs of wire leads for two filaments, each pair of said wire leads being folded back on opposite sides at opposite end portions of a flat base of the lamp, and a socket having a recess provided with electrical contacts for contacting with said two pairs of wire leads for introducing said flat base into said socket to couple said lamp and socket together.

DETAILED DESCRIPTION

Figure 1:
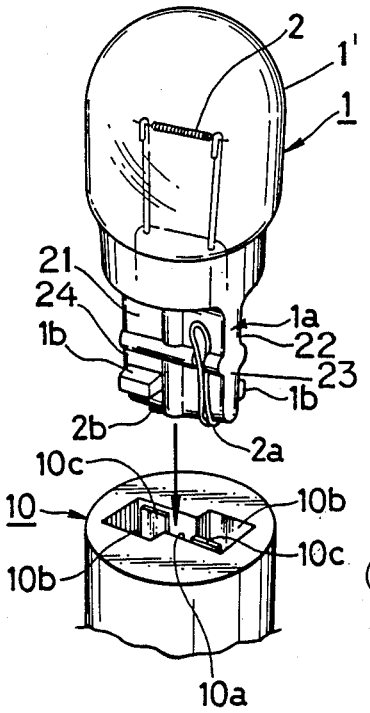
FIG. 1 is a perspective view of an embodiment of a single filament type wedge-base lamp and socket assembly according to the present invention.

Referring to FIG. 1 an assembly of the present invention comprises a single filament type wedge-base lamp and a socket generally indicated by reference numerals 1 and 10, respectively. The lamp 1 has an envelope 1; and a pair of wire leads 2*a* and 2*b* for a filament 2. The wire leads 2*a* and 2*b* are folded back on respective opposite sides (major surfaces) 21, 22 and at respective opposite end portions 23, 24 of a flat wedge base 1a of the lamp 1. Projections 1*b* and 1b are formed at end portions of base 1a on ends opposite to the first-mentioned opposite end portions, namely opposite to the wire leads 2*a* and 2*b*.

The socket 10 has a recess 10*a* provided with electrical contacts 10*c* and 10*c* for contacting with the pair of wire leads 2*a* and 2*b*. Recess 10*a* also is provided with clearance grooves 10*b* and 10*b* in the wall portions of said recess 10*a* corresponding in position to the projections 1*b* and 1*b* for receiving the flat wedge base 1ain the socket 10 to couple the lamp 1 and the socket 10 together. The electrical contacts 10c and 10c are constructed in a manner well known in the art, the details of which are omitted.

Figure 2:
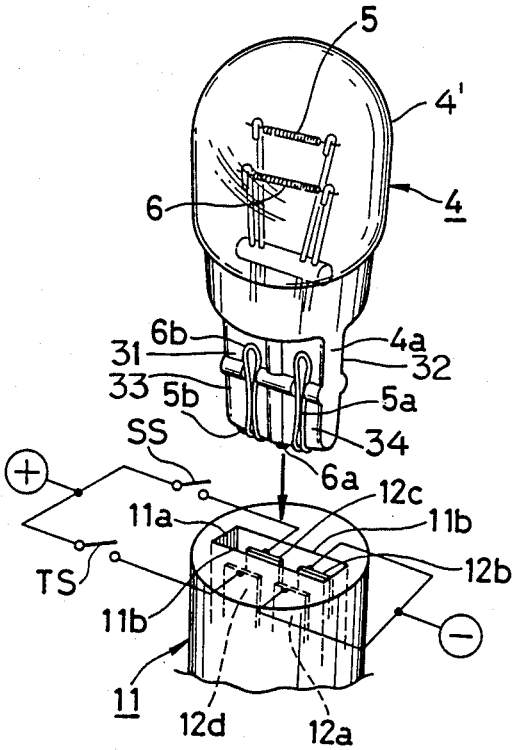
FIG. 2 is a perspective view of an embodiment of a double filament type wedge-base lamp and socket assembly according to the present invention.
Figure 3:
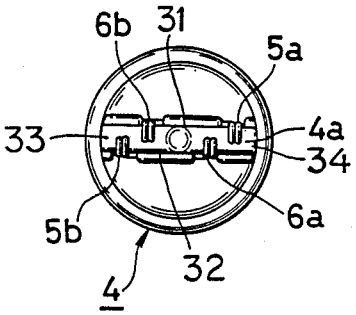
FIG. 3 is a bottom view of the flat base of the double filament type wedge-base lamp shown in FIG. 2.

Referring to FIG. 2, a double filament type assembly comprises a wedge-base lamp and a socket generally indicated by respective reference numerals 4 and 11. The double filament type wedge-base lamp 4 has an envelope 4,, and two pairs of wire leads 5*a*, 5*b* and 6*a*, 6*b* for two respective filaments 5 and 6. One pair of wire leads 5*a* and 5*b* are folded back on respective opposite side (major surfaces) 31, 32 at opposite end portions 33, 34 of a flat wedge base 4*a* of the lamp 4 in a similar manner to the single filament type wedge-base lamp 1 shown in FIG. 1. The other pair of wire leads 6*a* and 6*b* are folded back on respective opposite sides (major surfaces) 32, 31 at respective opposite end portions 34, 33 of the flat wedge base 4*a*, with the wire leads 6*a* juxtaposed with the wire lead 5*b* on major surface 32, and the wore lead 6*b* juxtaposed with the wire leads 5*a* on major surface 31. That is, the wire leads are juxtaposed respectively on the same respective sides of the flat wedge base. The wire lead arrangement is shown in FIG. 3 as seen from the bottom of the flat base 4*a*.

The socket 11 for the double filament type wedge-base lamp 4 also has a recess 11a provided with electrical contacts 12*a*, 12*c*, and 12*b*, 12*d* for contacting with the two pairs of wire leads. The flat wedge base 4*a* is introduced into the socket 11 to couple the lamp 4 and the socket 11 together. However, the recess 11a of the socket 11 is not provided with clearance grooves 10b, 10b, contrary to the first embodiment, and the recess wall is formed straight as shown by reference numeral 11*b* in FIG. 2. One pair of the electrical contacts 12*a* and 12*c* are supplied with electric power from (+) and (−) electrodes upon turning on a stop lamp switch SS for example, and the other pair of the electrical contacts 12*b* and 12*d* are supplied with electric power upon turning on a tail lamp switch TS.

As seen from the foregoing embodiments, the lamps 1 and 4 will operate even if they are inserted into the corresponding sockets 10 and 11 with their front sides of the base 1*a* and 4*a* located at the back. Further, the single filament lamp 1 cannot be inserted into the socket 11 for the double filament type wedge-base lamp 4 because of the presence of the projections lb, 1*b* on the flat wedge base 1*a*, thus avoiding erroneous coupling with the different type socket 11. Although the double filament type wedge-base lamp 4 may be inserted in the socket 10 for the single filament type wedge-base lamp 1, either one of the filaments 5 and 6 of the double filament type lamp will operate, thus posing no problem.

As appreciated from the foregoing description of this invention, since the single filament type wedge-base lamps are formed with projections, they cannot be inserted into the socket for a double filament type wedge-base lamp, thus avoiding fatal malfunction of the electrical system. Further, even if the double filament type wedge-base lamp is inserted into the socket for the single filament type wedge-base lamp, either one of the two filaments will properly operate, so that there is no problem. Accordingly, double filament type wedge-base lamps can be used widely and cost effectively in this field of the art, e.g., as stop/tail lamps.

We claim:

1. A wedge-base lamp and socket assembly system, comprising:

a first wedge-base lamp including:

a lamp envelope;

a substantially flat wedge base extending from said envelope, said wedge base having first and second opposite major surfaces, said opposite major surfaces each having first and second opposite end portions, said first end portion of said first major surface being on the same end of said wedge base as said first end portion of said second major surface, and said second end portion of said first major surface being on the same end of said wedge base as said second end portion of said second major surface;

a single filament supported inside of said lamp envelope;

first and second wire leads electrically coupled to said single filament, said wire leads passing through said wedge base between said major surfaces, and said wire leads having respective portions extending externally of said lamp, the externally extending portion of said first wire lead being folded back on said first major surface of said wedge base at said first end portion thereof, and the externally extending portion of said second wire lead being folded back on said second major surface of said wedge base at said second end portion thereof; and a first projection formed on said first major surface of said wedge base at said second end portion thereof, and a second projection formed on said second major surface of said wedge base at said first end portion thereof;

a second wedge-base lamp selectively interchangeable with said first wedge-base lamp, said second wedge-base lamp including:

a lamp envelope;

a substantially flat wedge base extending from said envelope, said wedge base having first and second opposite major surfaces, said opposite major surfaces each having first and second opposite end portions, said first end portion of said first major surface being on the same end of said wedge base as said first end portion of said second major surface, and said second end portion of said first major surface being on the same end of said wedge base as said second end portion of said second major surface;

first and second filaments supported inside of said lamp envelope;

first and second wire leads electrically coupled to said first filament, said first and second wire leads passing through said wedge base between said major surfaces, and said first and second wire leads having respective portions extending externally of said lamp, the externally extending portion of said first wire lead being folded back on said first major surface of said wedge base at said first end portion thereof, and the externally extending portion of said second wire lead being folded back on said second major surface of said wedge base at said second end portion thereof;

third and fourth wire leads electrically coupled to said second filament, said third and fourth leads passing through said wedge base between said major surfaces, said third and fourth wire leads having respective portions extending externally of said lamp, the externally extending portion of said third wire lead being folded back on said first major surface of said wedge base at said second end portion thereof, and the externally extending portion of said fourth wire lead being folded back on said second major surface of said wedge base at said first end portion thereof;

a socket for selectively receiving a wedge base of a wedge-base lamp therein, said socket including:

a recess for receiving therein said substantially flat wedge base of said lamp; and in respective positions for contacting with said first and second wire leads when said wedge base of said first wedge-base lamp is received in said recess; and a pair of clearance grooves in a wall of said recess and corresponding in position to said respective projections of said substantially flat wedge base of said first wedge-base lamp and for receiving said respective projections of said first wedge-base lamp in said clearance grooves;

whereby said substantially flat wedge base of said first wedge-base lamp, with said single filament, said projections and said wire leads, is receivable in said recess of said socket with said projections received in respective clearance grooves to couple said first wedge-base lamp and said socket together and to make electrical contact between said wire leads of said first wedge-base lamp and said electrical contacts of said socket; and said substantially flat wedge base of said second wedge-base lamp, with said first, second, third and fourth wire leads, being receivable in said recess of said socket to couple at least said first and second or said third and fourth lead wires of said second wedge-base lamp to said electrical contacts in said recess of said socket, to thereby enable energizing of at least one of said filaments of said second wedge-base lamp.

2. The system of claim 1, further comprising a second socket for selectively receiving a substantially flat wedge base of a wedge-base lamp therein, said second socket including:

a recess for receiving therein said substantially flat wedge base of said lamp;

first, second, third and fourth electrical contacts in said recess and in respective positions for respectively contacting with said first, second, third and fourth wire leads of said second wedge-base lamp when said wedge base of said second wedge-base lamp is received in said recess of said second socket;

said second socket being devoid of said clearance grooves which are provided in said recess of said first-mentioned socket, said recess of said second socket having wall portions which abut against said projections of said first wedge-base lamp for preventing insertion of said first single filament wedge-base lamp into said second socket; and said substantially flat wedge base of second wedge-base lamp, with said first and second filaments and said first, second, third and fourth wire leads, being receivable in said recess of said second socket to couple to said first, second, third and fourth lead wires of said second wedge-base lamp to said first, second, third and fourth electrical contacts, respectively, in said recess of said second socket, to thereby enable selective energizing of one or both of said filaments of said second wedge-base lamp.

3. The system of claim 1, wherein said first projection is opposite said second wire lead, and said second projection is opposite said first wire lead.

4. A wedge-base lamp and socket assembly system, comprising:

a double filament wedge-base lamp including:

a lamp envelope;

a substantially flat wedge base extending from said envelope, said wedge base having first and second opposite major surfaces, said opposite major surfaces each having first and second opposite end portions, said first end portion of said first major surface being on the same end of said wedge base as said first end portion of said second major surface, and said second end portion of said first major surface being on the same end of said wedge base as said second end portion of said second major surface;

first and second filaments supported inside of said lamp envelope;

first and second wire leads electrically coupled to said first filament, said first and second wire leads passing through said wedge base between said major surfaces, and said first and second wire leads having respective portions extending externally of said lamp, the externally extending portion of said first wire lead being folded back on said first major surface of said wedge base at said first end portion thereof, and the externally extending portion of said second wire lead being folded back on said second major surface of said wedge base at said second end portion thereof;

third and fourth wire leads electrically coupled to said second filament, said third and fourth leads passing through said wedge base between said major surfaces, said third and fourth wire leads having respective portions extending externally of said lamp, the externally extending portion of said third wire lead being folded back on said first major surface of said wedge base at said second end portion thereof, and the externally extending portion of said fourth wire lead being folded back on said second major surface of said wedge base at said first end portion thereof;

a non-polarized single filament wedge-base lamp including:

a lamp envelope;

a substantially flat wedge base extending from said envelope, said wedge base having first and second opposite major surfaces, said opposite major surfaces each having first and second opposite end portions, said first end portion of said first major surface being on the same end of said wedge base as said first end portion of said second major surface, and said second end portion of said first major surface being on the same end of said wedge base as said second end portion of said second major surface;

a single filament supported inside of said lamp envelope of said single filament wedge-base lamp;

first and second wire leads electrically coupled to said filament, said wire leads passing through said wedge base between said major surfaces, and said wire leads having respective portions extending externally of said lamp, the externally extending portion of said first wire lead being folded back on said first major surface of said wedge base at said first end portion thereof, and the externally extending portion of said second wire leads being folded back on said second major surface of said wedge base at said second end portion thereof; and a first projection formed on said first major surface of said wedge base at said second end portion thereof, and a second projection formed on said second major surface of said wedge base at said first end portion thereof;

a socket for selectively receiving a wedge base of said double filament wedge-base lamp therein, and for inhibiting insertion of said single filament wedge-base lamp therein, said socket including:

a recess for receiving therein said substantially flat wedge base of said double filament wedge-base lamp;

first, second, third and fourth electrical contacts in said recess and in respective positions for respectively contacting with said first, second, third and fourth wire leads when said wedge base of said double filament wedge-base lamp is received in said recess; and said recess having a wall portion corresponding in position to said respective projections of said substantially flat wedge base of said single filament wedge-base lamp for abutting said respective projections of said single filament wedge-base lamp for preventing insertion of said single filament wedge-base lamp into said recess, said substantially flat wedge-base of said double filament wedge-base lamp being receivable in said recess to couple said double filament lamp and socket together and to make electrical contact between said first, second, third and fourth wire leads and said first, second third and fourth electrical contacts, respectively; and said first and second projections of said single filament wedge-base lamp being adapted to be received in respective clearance grooves in a single filament socket to permit insertion of said single filament wedge-base lamp into the single filament socket.

5. The lamp and socket assembly system of claim 4, wherein said first projection of said single filament wedge-base lamp is opposite said second wire lead, and said second projection of said single filament wedge-base lamp is opposite said first wire lead.

* * * * *

UNITED STATES PATENT AND TRADEMARK OFFICE

CERTIFICATE OF CORRECTION

PATENT NO. : 4,932,901

DATED : June 12, 1990

INVENTOR(S) : MURAKAMI et al

It is certified that error appears in the above-identified patent and that said Letters Patent is hereby corrected as shown below:

Title page, [73] Assignee, replace "Tokyo Electric Co.,Ltd." with --Stanley Electric Co., Ltd.--.

Column 2, line 25, change "lain" to --la in--.

Column 2, line 45, change "wore" to --wire--.

Column 6, claim 4, line 23, change "leads" to --lead--.

Signed and Sealed this

Nineteenth Day of May, 1992

*Attest:*

DOUGLAS B. COMER

*Attesting Officer*

*Acting Commissioner of Patents and Trademarks*